US007082785B2

(12) United States Patent
Nieter et al.

(10) Patent No.: US 7,082,785 B2
(45) Date of Patent: Aug. 1, 2006

(54) OIL SEPARATOR FOR VAPOR COMPRESSION SYSTEM COMPRESSOR

(75) Inventors: Jeffrey J. Nieter, Coventry, CT (US); Tobias Sicnel, East Hampton, CT (US); William A. Rioux, Willington, CT (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/889,701

(22) Filed: Jul. 13, 2004

(65) Prior Publication Data

US 2006/0010904 A1 Jan. 19, 2006

(51) Int. Cl.
*F25B 43/02* (2006.01)

(52) U.S. Cl. ..... 62/470; 62/505; 417/371

(58) Field of Classification Search ..... 62/470, 62/505; 417/313, 371; 418/83–101
See application file for complete search history.

(56) References Cited

U.S. PATENT DOCUMENTS 3,064,449 A * 11/1962 Rigney ..... 62/470
3,149,478 A * 9/1964 Anderson ..... 62/469
3,163,999 A * 1/1965 Ditzler et al. ..... 62/469
3,408,828 A * 11/1968 Henri et al. ..... 62/470
3,945,219 A * 3/1976 Kasahara ..... 62/469
4,255,099 A 3/1981 Komori
4,496,293 A * 1/1985 Nakamura et al. ..... 417/371
5,001,908 A * 3/1991 Mayer ..... 62/470
5,062,773 A 11/1991 Kawai et al.
5,159,820 A 11/1992 Ohishi et al.
5,421,708 A 6/1995 Utter et al.
5,931,649 A * 8/1999 Caillat et al. ..... 418/55.1
6,000,233 A 12/1999 Nishida et al.
6,185,955 B1 2/2001 Yamamoto
6,508,073 B1 1/2003 Noro et al.

FOREIGN PATENT DOCUMENTS

| | | |
|---|---|---|
| EP | 1321730 | 6/2003 |
| JP | 2000274844 | 10/2000 |
| JP | 2001294886 | 10/2001 |
| JP | 2003139420 | 5/2003 |

* cited by examiner

*Primary Examiner*—William E. Tapolcai
(74) *Attorney, Agent, or Firm*—Carlson, Gaskey & Olds

(57) ABSTRACT

A transcritical vapor compression system includes a compressor assembly that includes an oil separator for separating oil from refrigerant. The oil separator is disposed between a motor and a compression chamber in a sub-critical portion of the vapor compression system. Oil emitted from the drive assembly attached to the motor is substantially removed from the refrigerant before entering the compression chamber of the compressor.

16 Claims, 4 Drawing Sheets

OIL SEPARATOR FOR VAPOR COMPRESSION SYSTEM COMPRESSOR

BACKGROUND OF THE INVENTION

This invention generally relates to a compressor for a vapor compression system, and specifically to a compressor for a vapor compressor system including an oil separator.

Compressors employ a motor for driving a pump mechanism to compress fluid and, therefore, typically contain lubricant for reducing friction between sliding surfaces. In hermetic or semi-hermetic compressors, an electric motor drives the pump mechanism through a driveline assembly. Refrigerant from the vapor compression system may flow over and around the motor and portions of the driveline. Lubricant typically flows through and around portions of the driveline to lubricate the sliding surfaces.

Although the primary lubricant flow path is mostly separate from the refrigerant flow path, some lubricant still can become mixed with the refrigerant. Lubricant mixed in with the refrigerant can reduce efficiency and reliability of the vapor compression system. Lubricant carried along with the refrigerant flow can inhibit heat transfer and reduce the effectiveness of heat exchangers. Further, lubricant carried with the refrigerant can plug small holes and inhibit performance of system components such as expanders. In addition, lubricant carried with the refrigerant can accumulate in unwanted or unexpected places within the compression system and may result in a loss of lubricant available for reducing friction and wear inside the compressor, thus reducing reliability.

A transcritical vapor compression system includes a refrigerant exiting the compressor in a supercritical state. Refrigerant enters the compressor in a low-pressure state and commonly flows over the electric motor to aid in cooling the motor and reducing its operating temperature. Oil from the driveline can mix with the refrigerant and enter a compression chamber with the refrigerant. It is common to employ an oil-separating device to separate the oil from the refrigerant. Typically, an oil-separating device is employed after the compression chamber in the high-pressure portion of the system. In a transcritical system, this in the supercritical state. Oil separators typically include a passage for draining oil back to an oil sump on the low-pressure, sub-critical portion of the vapor compression system. This passage creates a constant leak within the vapor compression system that can reduce system efficiency.

Oil separators disposed after the compression chamber must include relatively thicker walls, and high-pressure seals to accommodated the greater pressures. Further, refrigerants in a super-critical state, particularly carbon dioxide, tend to be extremely soluble. This causes oil to be saturated within the supercritical refrigerant. Oil saturated within the super critical refrigerant is very difficult to remove efficiently. The difficulties caused by the use of an oil separator on the supercritical side of a vapor compression system limit some systems to run entirely below a critical point. This can limit the type of refrigerant utilized in the system.

Accordingly, it is desirable to develop a low-pressure side oil separator for separating oil from refrigerant.

SUMMARY OF INVENTION

This invention is a compressor including a low-pressure oil separator for a transcritical vapor compression system that separates oil from refrigerant after the refrigerant passes over a drive motor and before entering a compression chamber.

A transcritical vapor compression system utilizing carbon dioxide as the refrigerant cycles between a high pressure above a critical point and a low pressure below the critical point. The compressor assembly includes a motor, a drive assembly, an oil separator, a compressor chamber and an oil sump. Refrigerant flows over and around the drive motor to reduce its operating temperature. The drive assembly includes moving parts that are lubricated by oil. Oil within the drive assembly in some instances mixes with the refrigerant.

The oil separator is disposed after the compressor motor but before the compression chamber. In this position oil is removed from the refrigerant prior to compression above the critical point. The oil separator removes substantially all of the oil that may become mixed with refrigerant prior to the refrigerant entering the compression chamber. Oil removed with an oil separator is transferred to an oil sump that is also on the low-pressure or sub-critical portion of the transcritical vapor compression system.

Accordingly, the compressor of this invention includes a low-pressure side oil separator for removing oil from refrigerant before the refrigerant enters the compression chamber.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
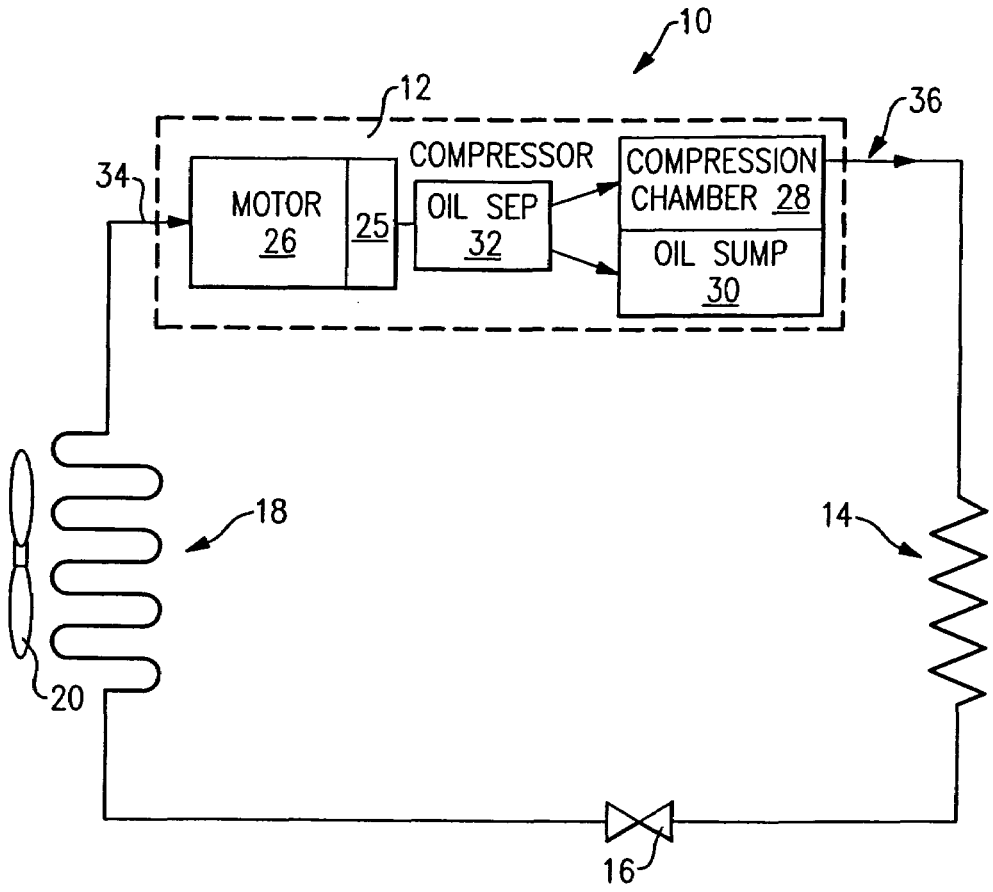
FIG. 1 is a schematic view of a transcritical vapor compression system according to this invention.

Referring to FIG. 1, a transcritical vapor compression system 10 includes a compressor 12, a heat exchanger 14, an expansion valve 16, and an evaporator 18. A fan 20 is provided for blowing air across the evaporator 18. The vapor compression system 10 preferably uses carbon dioxide as the refrigerant. However, other refrigerants that are known to workers skilled in the art are also within the contemplation of this invention.

Refrigerant within the vapor compression system 10 exits the compression chamber 28 of the compressor 12 at a temperature and pressure above a critical point. The refrigerant flows through the heat exchanger 14. Heat from the refrigerant is rejected to another fluid medium for use in heating water or air. The high-pressure, high temperature refrigerant then moves from the heat exchanger 14 to an expansion valve 16. The expansion valve 16 regulates flow of refrigerant between high and low pressures.

Refrigerant exiting the expansion valve 16 flows to the evaporator 18. In the evaporator 18 the refrigerant accepts heat from the outside air. The fan 20 blows air across the evaporator 18 to improve the efficiency of this process. Refrigerant leaving the evaporator 18 enters the compressor 12 at an inlet 34. Refrigerant flows around and over a motor 26. Refrigerant flowing around the motor absorbs a portion of heat generated by the motor 26 to reduce its operating temperature.

The moving parts of a driveline assembly 25 connected to the motor 26 inside compressor 12 require lubrication and are therefore provided with a lubricant such as oil. This lubricant is preferably maintained within the driveline assembly 25 attached to motor 26 such that no oil is emitted into the refrigerant flow. However, in some instances some oil becomes intermixed with the refrigerant used to cool the motor 26.

The compressor 12 of this invention includes an oil separator 32 that is disposed between the motor 26 and the compression chamber 28. Refrigerant flowing over the motor 26 flows into an oil separator 32. The oil is then substantially removed from the refrigerant and directed towards an oil sump 30 for reuse to lubricate the moving parts of the drive assembly 25 attached to the motor 26 inside the compressor 12. The substantially oil free refrigerant exits the oil separator 32 and enters the compression chamber 28. The oil separator 32 can comprise coalescing medium, serpentine passages, centrifugal separators or other devices.

Figure 2:
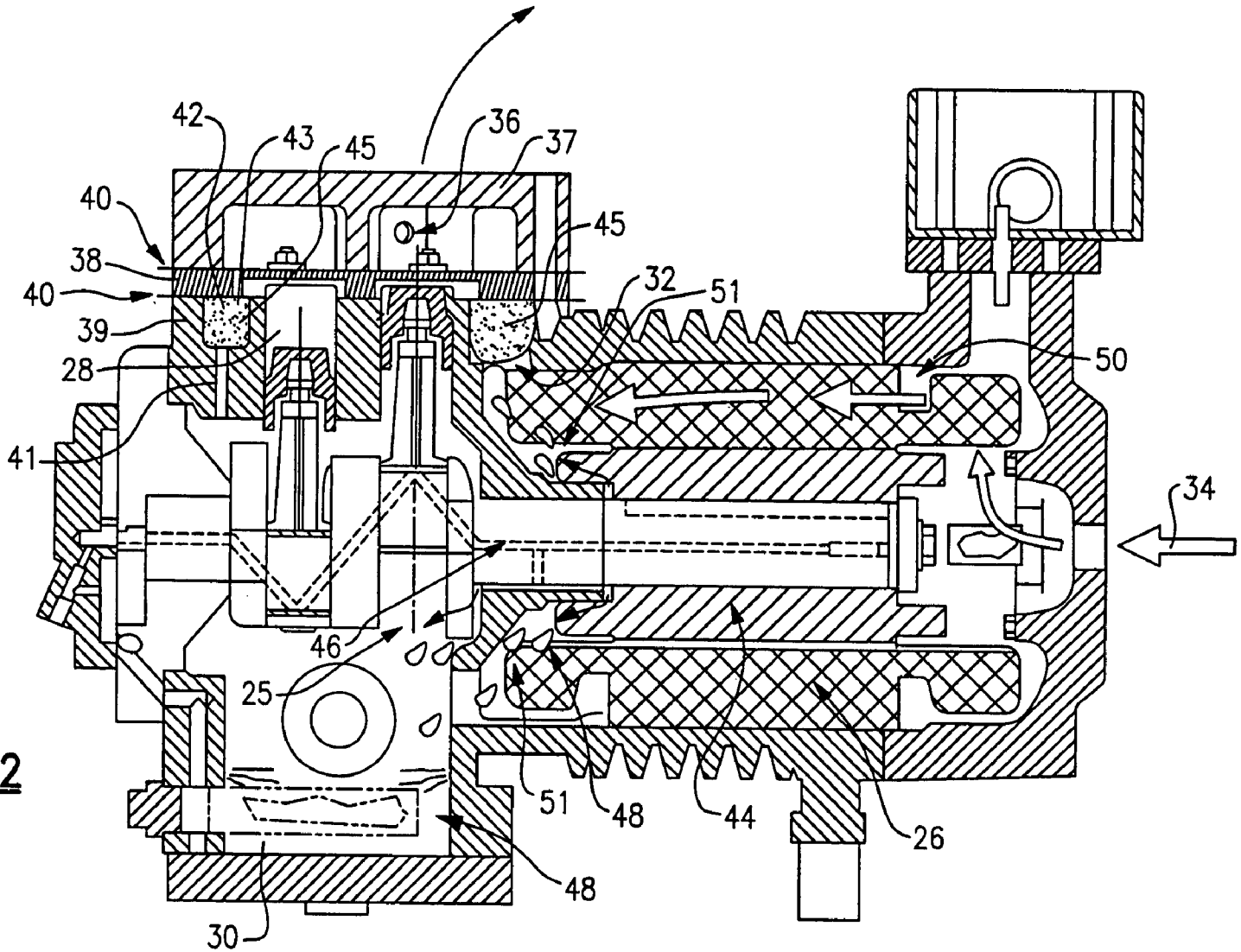
FIG. 2 is a cross-sectional view of a compressor including an oil separator according to this invention.

Referring to FIG. 2, a cross-sectional view of a compressor 12 according to this invention is shown and includes an inlet 34 for entering sub-critical refrigerant and an outlet 36 for exiting supercritical refrigerant. Refrigerant flows through a flow path 50 disposed adjacent the motor 26. The flow path 50 directs refrigerant flow around the motor 26 to absorb heat radiating from the motor 26. The flow path 50 directs refrigerant flow from the inlet 34 over the motor 26 and to a suction plenum 42.

Preferably, the flow path 50 is annular about the motor 26. The motor 26 includes a rotor 44 supported on at least one bearing 46. The bearing 46 includes a lubricant to limit or eliminate friction between sliding surfaces. The oil 48 in some instances can exit bearing 46 creating an oil-containing portion 51 within the flow path 50. The oil-containing portion 51 is disposed substantially adjacent bearing 46. Oil within the refrigerant flow, if allowed to remain within the refrigerant flow would enter the compression chamber 28 of the compressor 12 and flow with the refrigerant to the high-pressure portion of this system.

A valve plate 38 is mounted to a crankcase 39 and a head cover 37 is attached to the valve plate 38. Gaskets 40 seal the interface between the crankcase 39, valve plate 38 and head cover 37. The oil separator 32 is disposed within the suction plenum 42. The suction plenum 42 is in communication with a plurality of passages 43 defined within the valve plate 38. The passages within the valve plate 38 communicate refrigerant from the flow path 50 to the suction plenum 42.

A coalescing material 45 is disposed within the suction plenum 42. The coalescing material 45 is preferably a highly porous material that allows refrigerant flow while capturing oil droplets. The coalescing material may be a porous metal or synthetic material. Refrigerant containing oil 48 flows through the suction plenum 42 to the compression chambers 28. Oil within the refrigerant is separated and accumulated within the coalescing material 45. The coalescing material 45 collects and gathers the oil and drains it to a sump. An oil outlet 41 is provided to communicate oil from the suction plenum 42 to the oil sump. By locating the oil separator 32 before the compression chambers 28, in the sub-critical portion of the transcritical vapor compression system 10, the oil can be more effectively removed from the refrigerant flow.

Figure 3:
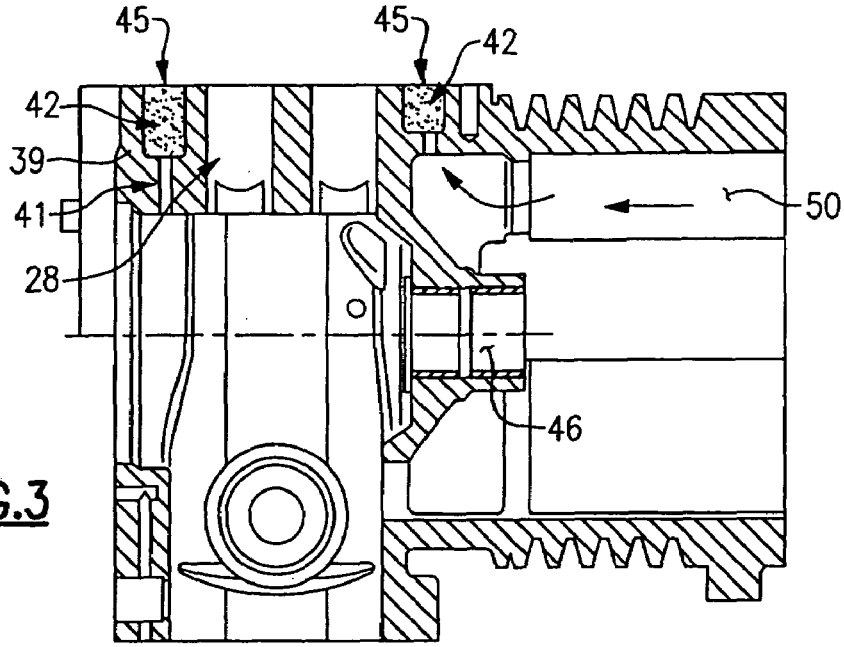
FIG. 3 is an enlarged cross sectional view of the compressor according to this invention.

Referring to FIG. 3, an enlarged cross-section of the compression chamber 28 and crankcase 39 is shown. The suction plenum 42 includes the coalescing medium 45.

Figure 4A:
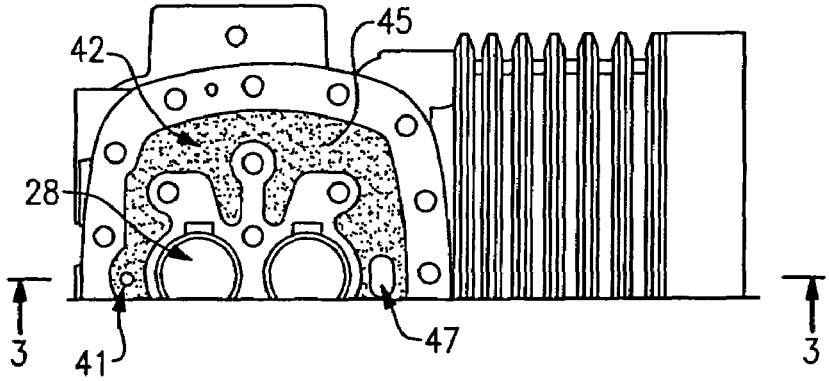
FIG. 4A is a top view of a suction plenum including an oil coalescing medium.

Referring to FIG. 4A, the suction plenum 42 is shown where the refrigerant is collected before entering the compression chambers 28 through the passages 43. Refrigerant enters the suction plenum 42 through inlet 47. The suction plenum 42 is filled with coalescing medium 45. Refrigerant permeates through the coalescing medium 45 while the oil is collected on the surface of the coalescing material 45. Oil drains off through the outlet 41 to the oil sump 30.

Figure 4B:
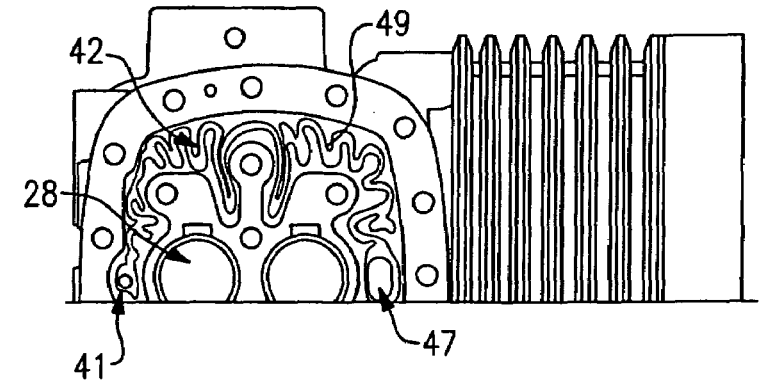
FIG. 4B is a top view of an example suction plenum including serpentine passages for separating oil from refrigerant.

Referring to FIG. 4B, the suction plenum 42 is shown including serpentine passages 49 for the refrigerant to flow through prior to entering the compression chambers 28 through the passages 43. Refrigerant enters the suction plenum 42 through inlet 47 and oil impinges on the walls of the serpentine passages 49 and away from the refrigerant that continues on toward the compression chambers 28. Oil then eventually works over to the outlet 41 and the oil sump 30.

Figure 5:
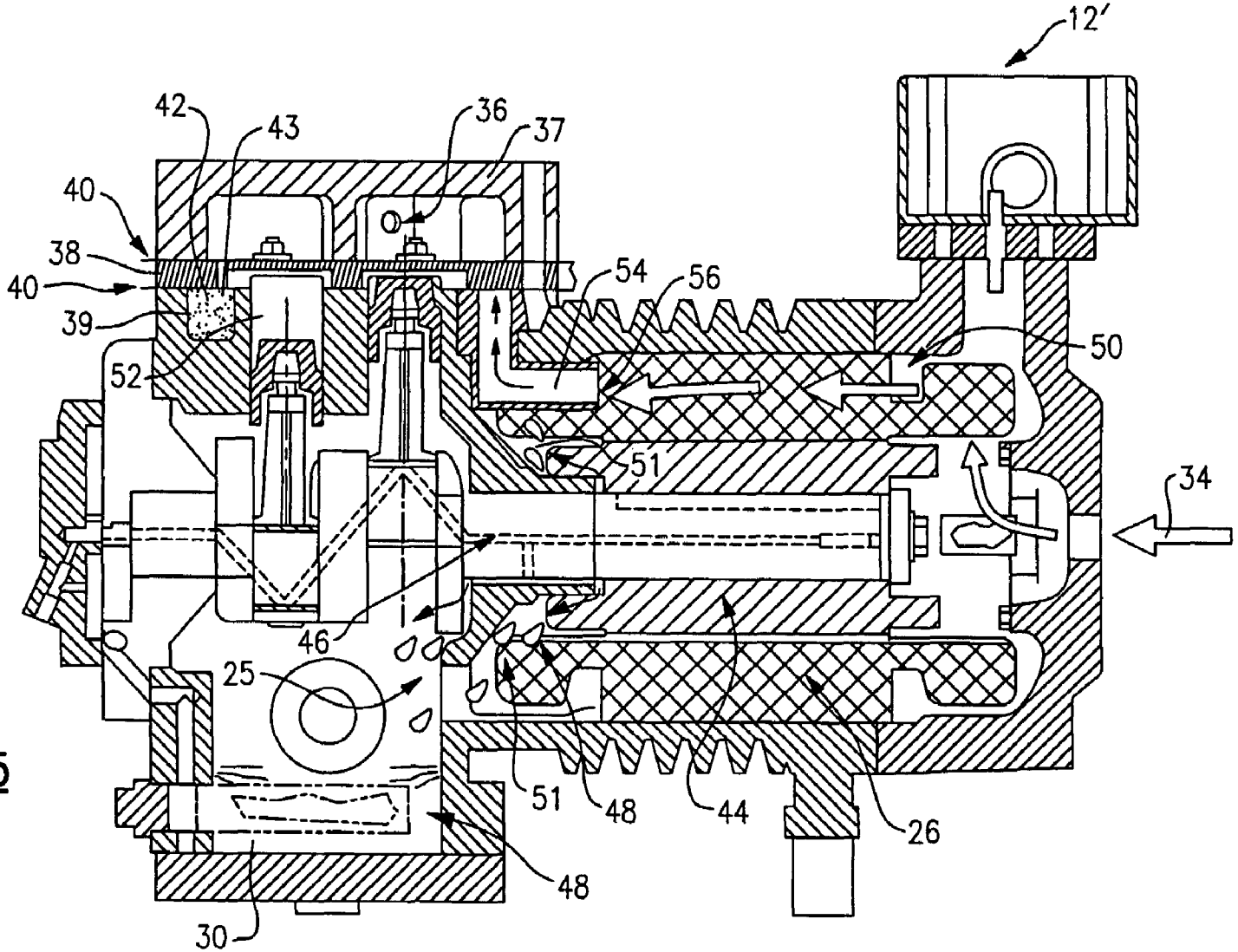
FIG. 5 is a cross-sectional view of a compressor including an oil isolation passage according to this invention.

FIG. 5 is a cross-sectional view of a compressor 12' according to this invention. The compressor 12' includes a passage 54 that directs refrigerant flowing around the motor 26 to the suction plenum 42. The passage 54 extends into the refrigerant flow path 50 a distance from the oil containing portion 51, and includes an inlet 56 spaced apart from the oil-containing portion 51 of the flow path 50. Because the inlet 56 of the passage 54 is spaced apart from the oil-containing portion 51 of the refrigerant flow path 50, refrigerant entering the inlet 56 does not contain oil that may have been emitted from bearing assemblies 46. Passage 54 isolates refrigerant of the oil-containing portion 51 from refrigerant within the flow path 50. Isolation of the oil-containing portion 51 of the refrigerant substantially prevents oil 48 from becoming intermixed with refrigerant flowing into the compression chambers 28.

In operation refrigerant enters the inlet 34 at a sub-critical point and flows around the motor 26. The refrigerant flows around the motor 26 in an annular flow path 50. Refrigerant within the annular flow path 50 absorbs heat from the motor 26 to reduce its operating temperature. The inlet 56 of the passage 54 is spaced apart from the bearing 46 to direct refrigerant into the suction plenum 42 before becoming intermixed with oil in the oil-containing portion 51. Thus, the inlet 56 is spaced apart from the bearing 46 such that substantially no oil is drawn into the compression chamber 28.

Location of the oil separator 32 after the motor 26 and before the compression chamber 28 in the sub-critical portion of the vapor compression system 10, removes oil more effectively without the difficulties experienced by removing oil in the supercritical portion of the vapor compression system.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

The invention claimed is:

1. A vapor compression system comprising:

a circuit containing refrigerant;

a compressor comprising a motor, a driveline assembly, and a compression chamber, wherein said compressor includes a refrigerant suction flow path providing for the flow of refrigerant over said motor for at least partially cooling said motor; and an oil separator disposed within said refrigerant suction flow path between said motor and said compression chamber.

2. The system of claim 1, wherein a pressure of said refrigerant within said oil separator is less than a pressure of refrigerant exiting said compression chamber.

3. The system of claim 1, wherein said refrigerant comprises Carbon Dioxide.

4. The system of claim 1, wherein said refrigerant is above a critical point upon exiting said compression chamber, and below said critical point within said oil separator.

5. The system of claim 1, wherein said vapor compression system is transcriticle.

6. The system of claim 1, comprising an oil sump for receiving oil from said oil separator.

7. The system of claim 1, wherein said oil separator comprises a coalescing medium.

8. The system of claim 1, wherein said oil separator comprises a plurality of serpentine passages.

9. The system of claim 1, wherein said compressor comprises a suction plenum, and said oil separator is disposed within said suction plenum.

10. The system of claim 9, wherein said oil separator comprises a coalescing medium.

11. The system of claim 10, wherein said coalescing medium comprises steel foam.

12. The system of claim 1, comprising a passage extending into said refrigerant suction flow path for directing refrigerant into said compression chamber, said passage including an inlet spaced apart from oil escapement areas of said drive assembly.

13. A compressor assembly for a transcritical vapor compression system comprising:

a motor;

a dive assembly;

a refrigerant flow passage directing a portion of refrigerant flow over said drive assembly for cooling said drive assembly;

a compression chamber;

a suction plenum defining a passage for refrigerant to said compression chamber; and an oil separator disposed within said suction plenum.

14. The assembly of claim 13, wherein said oil separator comprises a coalescing medium.

15. The assembly of claim 13, wherein said oil separator comprises serpentine passages.

16. The assembly of claim 13, wherein a refrigerant exiting said compression chamber is above a critical point, and refrigerant entering said compression chamber is below said critical point.

* * * * *

UNITED STATES PATENT AND TRADEMARK OFFICE

CERTIFICATE OF CORRECTION

PATENT NO. : 7,082,785 B2
APPLICATION NO. : 10/889701
DATED : August 1, 2006
INVENTOR(S) : Nieter et al.

It is certified that error appears in the above-identified patent and that said Letters Patent is hereby corrected as shown below:

ON THE TITLE PAGE:

Inventor Sienel's State Should Read As Follows:

(75) Inventors: Tobias Sienel, East Hampton, MA (US);

Claim 13, Column 6, line 15: "dive" should be --drive--

Signed and Sealed this

Thirty-first Day of October, 2006

JON W. DUDAS
*Director of the United States Patent and Trademark Office*